US005622817A

United States Patent [19]

Willsau et al.

[11] Patent Number: 5,622,817

[45] Date of Patent: Apr. 22, 1997

[54] COLOR PHOTOGRAPHIC RECORDING MATERIAL

[75] Inventors: Johannes Willsau; Heinrich Odenwälder, both of Leverkusen, Germany

[73] Assignee: Agfa-Gevaert AG., Germany

[21] Appl. No.: 511,057

[22] Filed: Aug. 3, 1995

[30] Foreign Application Priority Data

Aug. 16, 1994 [DE] Germany ..... 44 29 030.6

[51] Int. Cl.[6] ..... G03C 7/305

[52] U.S. Cl. ..... 430/543; 430/505; 430/598; 430/599; 430/600; 430/603; 430/955

[58] Field of Search ..... 430/505, 955, 430/543, 598, 599, 600, 603

[56] References Cited

U.S. PATENT DOCUMENTS

| | | | |
|---|---|---|---|
| 4,518,682 | 5/1985 | Kobayashi et al. | 430/543 |
| 4,724,199 | 2/1988 | Kobayashi et al. | 430/955 |
| 4,734,357 | 3/1988 | Mihayashi et al. | 430/505 |
| 4,820,616 | 4/1989 | Matejec et al. . | |
| 4,994,358 | 2/1991 | Deguchi et al. . | |
| 5,213,942 | 5/1993 | Deguchi et al. . | |

FOREIGN PATENT DOCUMENTS

| | | | |
|---|---|---|---|
| 3605713A1 | 8/1987 | European Pat. Off. . | |
| 0399460 | 11/1990 | European Pat. Off. | 430/955 |
| 3333355 | 3/1984 | Germany . | |
| 1106052 | 4/1989 | Japan | 430/505 |

*Primary Examiner*—Lee C. Wright
*Attorney, Agent, or Firm*—Connolly & Hutz

[57] ABSTRACT

A color negative film which contains support, at least one light-sensitive silver halide emulsion layer containing a color coupler and at least one light-insensitive layer adjacent thereto which contains a compound which reacts with the developer oxidation product during development with the splitting off of a radical which increases the sensitivity and which corresponds to formulas I or II $$A\text{-}B\text{-}(T_1)_m\text{-}(COUP\text{-}D)\text{-}(T_2)_n \quad (I)$$

$$A\text{-}B\text{-}(T_1)_m D \quad (II).$$

6 Claims, No Drawings

COLOR PHOTOGRAPHIC RECORDING MATERIAL

This invention relates to a colour photographic silver halide material of the negative type having improved sensitivity.

It is known that the sensitivity of photographic silver halide materials can be increased by means of what are termed DAR and FAR couplers (development accelerator releasing and fogging agent releasing coupler, respectively), which are used in the silver halide emulsion layer containing a coupler and which split off either a development accelerator or a fogging agent during the coupling reaction with the developer oxidation product. However, the increase in sensitivity obtained in this manner is still not sufficient for the purposes of many applications. In addition, fogging and granularity are increased by an undesirable extent (e.g. DE 33 33 355).

The object of the present invention is to provide additives for photographic materials by means of which an increase in sensitivity can be obtained without a simultaneous increase in granularity and fogging.

Surprisingly, it has now been found that an increase in sensitivity such as this is obtained if compounds which during development split off a radical which increases the sensitivity are used in a light-insensitive layer which is adjacent to a light-sensitive silver halide emulsion layer containing a coupler. An adjacent layer is understood to be both the layer which directly adjoins the light-sensitive layer and the following layer.

For example, these compounds may be DAR couplers, FAR couplers and compounds which during development split off or cleave a 4-equivalent coupler containing a bonding group with an affinity for silver halide. The latter compounds are hereinafter termed ACR compounds (adsorbing coupler releasing compounds). In this respect the radical of the compound which splits off the 4-equivalent coupler contains a ballast group which makes the compound resistant to diffusion, whilst the coupler which is split off contains a group with an affinity for silver, halide, by means of which it is adsorbed on the silver halide grain.

ACR couplers preferably correspond to formula I $$A\text{-}B\text{-}(T_1)_m\text{-}(COUP\text{-}D)\text{-}(T_2)_n \quad (I),$$

where

A represents a ballast radical,

B represents the radical of a compound which reacts during development with the splitting off of $(T_1)_m$-(COUP-D)-$(T_2)_n$, $T_1$ and $T_2$ are time control elements which can be split off during development, m, n represent 0 or 1, COUP represents the radical of a 4-equivalent coupler, and D represents a group with an affinity for silver halide.

Suitable groups D with an affinity for silver halide preferably correspond to formulae IIa to IIe:

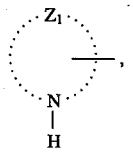

IIa

-continued

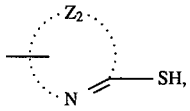

IIb

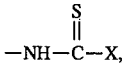

IIc

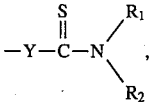

IId

IIe where $Z_1$ represents the remaining members for the completion of what is preferably a 5- or 6-membered ring which contains at least one additional heteroatom such as a nitrogen atom or a sulphur atom, $Z_2$ represents the remaining members for the completion of what is preferably a 5- or 6-membered ring, X represents —$NH_2$, —NHR,

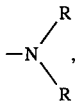

—NH—$NH_2$, —NH—NHR, —SR, —OR,

Y represents —S—, —NR—, —O—,

R represents an aliphatic, aromatic or heterocyclic radical, and $R_1$, $R_2$ represent H or an aliphatic, aromatic or heterocyclic radical, or jointly represent the remaining members of a 5- or 6-membered ring.

The group with an affinity for silver halide may be bonded to the 4-equivalent coupler directly or via an intermediate member Z.

Preferred divalent intermediate members Z are alkylene groups, arylene groups, —$COCH_2$—, —$COCH_2$—S—, —$COCH_2$—O—,

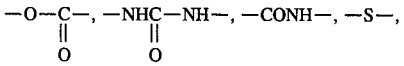

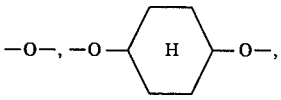

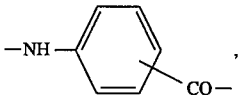

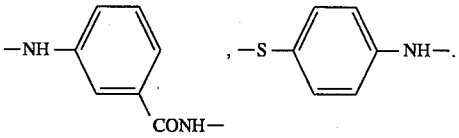

(COUP-D) may be bonded to $T_1$ via a bond to COUP or a bond to D. The same applies to $T_2$.

The group A-B may be a coupler radical, a redox compound, or a radical which does not affect the image, e.g. which can split off the $(T_1)_m$-(COUP-D)-$(T_2)_n$ group solely by means of the alkali of the developer. Suitable redox compounds are oxidizable compounds which can split off the $(T_1)_m$-(COUP-D)-$(T_2)_n$ group after their oxidation.

The release of (COUP-D) from a compound of formula I in which B is a coupler radical occurs by reaction with the developer oxidation product EOP according to the reaction scheme:

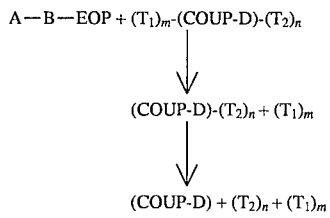

Known time control elements $T_1$ are described in U.S. Pat. Nos. 4,146,396, 4,248,962, 4,409,323, 4,421,845, DE 26 26 315 and U.S. Pat. No. 4,546,073. $T_1$ may also be a coupler radical. $T_2$ may be a hydrolysable group such as —$OCOCH_2Cl$, —OCO—phenyl, —$OSO_2CH_3$,

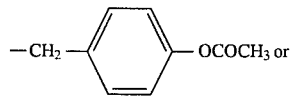

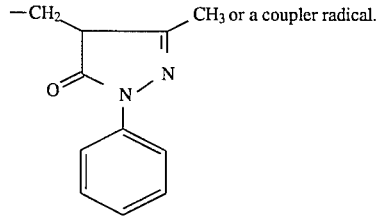

The group A-B is preferably the radical of a 2-equivalent coupler which contains the radical $(T_1)_m$-(COUP-D)-$(T_2)_n$ which can split off at the coupling site. (COUP-D) is preferably linked to B via the group D with an affinity for silver halide. (COUP-D) preferably does not contain a ballast radical which imparts resistance to diffusion.

As coupler radicals, B and COUP may be the radicals of yellow, magenta or cyan couplers or the radicals of couplers which do not produce a colour.

FAR couplers correspond to formula II, for example:

$$A\text{-}B\text{-}(T_1)_m\text{-}D_1 \qquad \text{(II)}$$

where A, B, $T_1$ and m have the meaning defined above and $D_1$ is the radical of a compound which exerts a fogging action on silver halide emulsions after its release.

Particular examples of the group B-$(T_1)_m$-$D_1$ include the following:

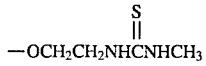

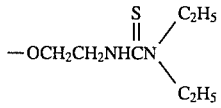

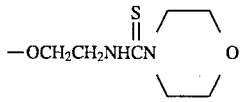

-continued

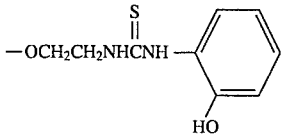

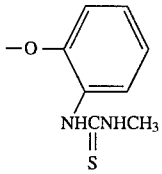

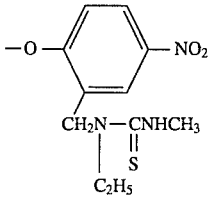

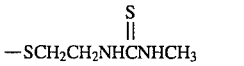

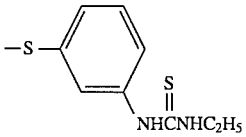

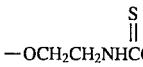

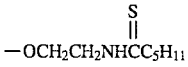

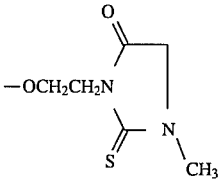

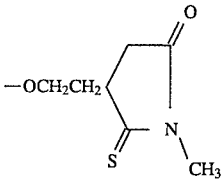

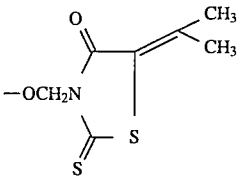

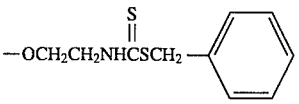

-continued

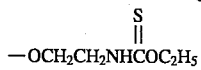

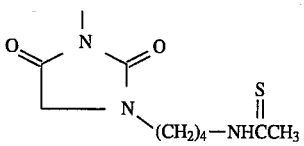

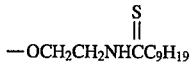

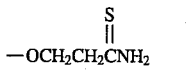

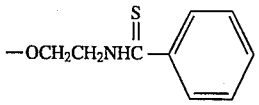

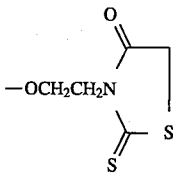

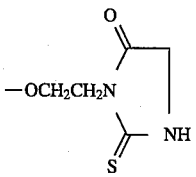

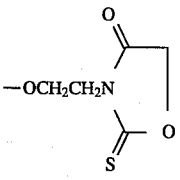

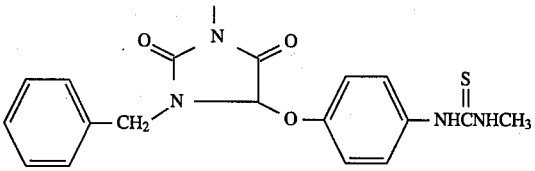

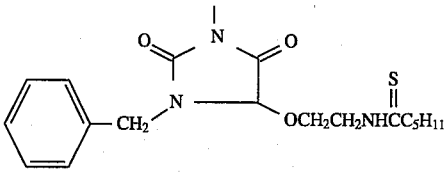

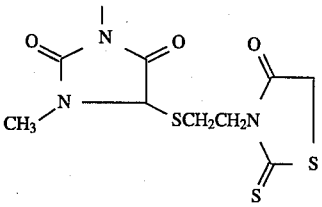

-continued

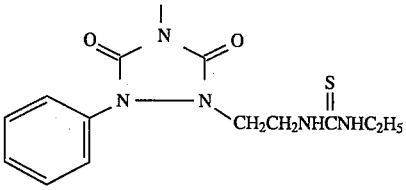

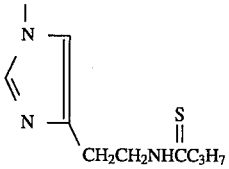

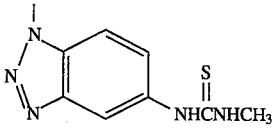

In particular, compounds of formulae I and II are used in an amount of 0.0005 to 0.05 mmole/$m^2$ of photographic material, wherein the total amount may be used in one layer or may be distributed over a plurality of layers. In double or triple layer stacks, the compounds of formula I or II are preferably used adjacent to the high-sensitivity layers. Instead of a compound of formula I or II, mixtures of several compounds corresponding to these formulae may be used, wherein the amount specified above is the total amount in this case.

Examples of colour photographic materials of the negative type include colour negative film, colour photographic paper, colour reversal film and colour reversal paper. The invention is particularly valuable for colour negative films.

Examples of suitable supports for the production of colour photographic materials such as these include films and foils of semi-synthetic and synthetic polymers such as cellulose nitrate, cellulose acetate, cellulose butyrate, polystyrene, polyvinyl chloride, polyethylene terephthalate and polycarbonate, and paper which is laminated with a layer of barytes or a layer of an α-olefine polymer (e.g. polyethylene). These supports may be coloured with dyes and pigments, for example titanium dioxide. They may also be coloured black for the purpose of screening from light.

The surface of the support is generally subjected to a treatment process in order to improve the adhesion of the photographic silver halide layer, for example a corona discharge with the subsequent deposition of a substrate layer.

The colour photographic materials usually contain at least one red-sensitive, green-sensitive and blue-sensitive layer in each case, and optionally contain intermediate layers and protective layers.

Binders, silver halide grains and colour couplers are essential constituents of the photographic emulsion layers.

Gelatine is preferably used as a binder. However, this may be completely or partially replaced by other synthetic, semi-synthetic or naturally occurring polymers. Examples of synthetic gelatine substitutes include polyvinyl alcohol, poly-N-vinylpyrrolidone, polyacrylamides, polyacrylic acid and their derivatives, particularly their mixed polymers. Examples of naturally occurring gelatine substitutes include other proteins such as albumin or casein, cellulose, sugar, starches or alginates. Semi-synthetic gelatine substitutes are generally modified natural products. Cellulose derivatives such as hydroxyalkyl cellulose, carboxymethyl cellulose and phthalyl cellulose, and gelatine derivatives which have been obtained by reaction with alkylating or acylating agents or by the grafting-on of polymerizable monomers, are examples of these.

The binders should contain a sufficient amount of functional groups so that sufficiently resistant layers can be produced by reaction with suitable hardeners. These functional groups comprise amino groups in particular, but may also comprise carboxyl groups, hydroxyl groups and active methylene groups.

The gelatines which are preferably used can be obtained by acidic or alkaline digestion. Oxidized gelatines may also be used. The production of such gelatines is described, for example, in The Science and Technology of Gelatine, edited by A. G. Ward and A. Courts, Academic Press 1977, page 295 et seq. The gelatines which are used in each case should comprise a content of photographically active impurities which is as low as possible (inert gelatines). Gelatines of high viscosity and with reduced swelling are particularly advantageous.

The silver halide which is present as the light-sensitive component in the photographic material may contain chloride, bromide or iodide or mixtures thereof as the halide. For example, the halide content of at least one layer may consist of 0 to 15 mole % of iodide, 0 to 100 mole % of chloride and 0 to 100 mole % of bromide. The colour photographic material according to the invention preferably contains silver bromide iodide emulsions containing 5 to 15 mole % silver iodide.

The crystals may be predominantly compact, e.g. those which are regular cubic or octahedral crystals or which comprise transitional forms. Lamellar crystals may also preferably be used, however, the average diameter to thickness ratio of which is preferably at least 5:1, the diameter of a grain being defined as the diameter of a circle with a circular area corresponding to the projected area of the grain. However, the layers may also comprise plate-like silver halide crystals in which the diameter to thickness ratio is significantly greater than 5:1, e.g. 12:1 to 30:1.

The silver halide grains may also have a multilayer grain structure. In the simplest case this comprises an inner and an outer grain region (core/shell) in which the composition and/or other modifications, e.g. the nature of the doping of the individual grain regions, are different. The average grain size of the emulsions is preferably between 0.2 μm and 2.0 μm, and the grain size distribution can be both homodisperse or heterodisperse. A homodisperse grain size distribution means that 95% of the grains do not differ by more than ±30% from the average grain size. In addition to the silver halide, the emulsions may also contain organic silver salts, e.g. silver benzotriazolate or silver behenate.

Two or more types of silver halide emulsions which are prepared separately may be used as a mixture.

The photographic emulsions may be prepared from soluble silver salts and soluble halides by various methods (e.g. P. Glafkides, Chimie et Physique Photographique, Paul Montel, Paris (1967); G. F. Duffin, Photographic Emulsion Chemistry, The Focal Press, London (1966); V. L. Zelikman et al., Making and Coating Photographic Emulsion, The Focal Press, London (1966)).

Apart from precipitation, the silver halide crystals may also be grown by physical ripening (Ostwald ripening) in the presence of excess halide and/or silver halide complexing agents. The growth of the emulsion grains may even be predominantly effected by Ostwald ripening, wherein a fine-grained, so-called Lippmann emulsion is preferably mixed with a difficultly soluble emulsion and reprecipitated on the latter.

Salts or complexes of metals such as Cd, Zn, Pb, Tl, Bi, Ir, Rh, or Fe may also be present during precipitation and/or physical ripening.

Moreover, precipitation may also be effected in the presence of sensitizing dyes. Complexing agents and/or dyes can be made ineffective at any desired time, e.g. by altering the pH or by oxidative treatment. After the completion of crystal formation, or even at an earlier stage, the soluble salts are removed from the emulsion, e.g. by forced washing, by flocculation and washing, by ultrafiltration, or by means of ion-exchangers.

The silver halide emulsion is generally subjected to chemical sensitization under defined conditions—pH, pAg, temperature, concentration of gelatine, silver halide and sensitizer —until the optimum between sensitivity and fogging is reached.

The mode of procedure is described, for example, by H. Frieser in "The Basis of Photographic Processes with Silver Halides", pages 675–734, Akademische Verlagsgesellschaft (1968).

In this respect, chemical sensitization may be effected with the addition of compounds of sulphur, selenium, tellurium and/or compounds of metals of Sub-Group VIII of the periodic system (e.g. gold, platinum, palladium, iridium). Further, thiocyanate compounds, surface-active compounds such as thioethers, heterocyclic nitrogen compounds (e.g. imidazoles, azaindenes) or spectral sensitizers (described, for example, by F. Hamer in "The Cyanine Dyes and Related Compounds" 1964, or in Ullmanns Encyclopädie der technischen Chemie [*Ullmann's Encyclopedia of Industrial Chemistry*], Fourth Edition, Volume 18, pages 431 et seq., and in Research Disclosure 17643, Section III) may also be added. Alternatively, or in addition, a reduction sensitization may be effected, with the addition of reducing agents (tin(II) salts, amines, hydrazine derivatives, aminoboranes, silanes, formamidinesulphinic acid), by means of hydrogen, or by means of a lower pH (e.g. lower than 5) and/or high pH (e.g. higher than 8).

The colour emulsions may contain compounds to prevent the formation of fogging or to stabilize the photographic function during production, storage or photographic processing.

Azaindenes are particularly suitable, preferably tetra- and pentaazaindenes, particularly those which contain hydroxyl or amino group substituents. Compounds of this type have been described by Birr, Z. Wiss. Phot. 47 (1952), pages 2–58, for example. In addition, salts of metals such as mercury or cadmium, aromatic sulphonic or sulphinic acids such as benzenesulphinic acid, or nitrogen-containing heterocycles such as nitrobenzimidazole or nitroindazole, or optionally substituted benzotriazoles or benzothiazolium salts, can be used as anti-fogging agents. Compounds which are particularly suitable comprise heterocycles which contain mercapto groups, such as mercaptobenzothiazoles, mercaptobenzimidazoles, mercaptotetrazoles, mercaptothiadiazoles and mercaptopyrimidines, wherein these mercaptoazoles may also contain a water-solubilizing group, e.g. a carboxyl group or a sulphonic group. Other suitable compounds are published in Research Disclosure 17643 (December 1978), Section VI.

The stabilizers may be added to the silver halide emulsions before, during or after the ripening of the latter. The compounds may of course be added to other photographic layers which are associated with a silver halide layer.

Mixtures of two or more of the said compounds may also be used.

The photographic emulsion layers or other hydrophilic colloid layers of the light-sensitive material produced according to the invention may contain surface-active agents for various purposes, such as coating media for preventing the build-up of an electrical charge, for improving the sliding properties, for emulsifying the dispersion, for preventing adhesion and for improving the photographic characteristics (e.g. for speeding up development, obtaining higher contrast, sensitization, etc.). Apart from natural surface-active compounds, e.g. saponin, synthetic surface-active compounds (surfactants) are primarily used: nonionic surfactants e.g. alkylene oxide compounds, glycerine compounds or glycidol compounds, cationic surfactants e.g. higher alkylamines, quaternary ammonium salts, pyridine compounds and other heterocyclic compounds, sulphonium compounds or phosphonium compounds, anionic surfactants containing an acid group e.g. a carboxylic acid or sulphonic acid group or a phosphoric acid, sulphuric acid ester or phosphoric acid ester group, amphoteric surfactants e.g. amino acid and amino sulphonic acid compounds, as well as sulphuric or phosphoric acid esters of an amino alcohol.

The photographic emulsions may be spectrally sensitized with the use of methine dyes or other dyes. Cyanine dyes, merocyanine dyes and complex merocyanine dyes are particularly suitable dyes.

A review of polymethine dyes which are suitable as spectral sensitizers, suitable combinations thereof and combinations thereof which have a supersensitizing effect is published in Research Disclosure 17643/1978, in Section IV.

The following dyes, classified by spectral regions, are particularly suitable:

as red-sensitizers: 9-ethylcarbocyanines having benzothiazole, benzoselenazole or napththothiazole as basic terminal groups, and which may contain halogen, methyl, methoxy, carbalkoxy or aryl substituents in the 5- and/or 6-position, and also 9-ethyl-naphthoxathia- or selenocarbocyanines and 9-ethyl-naphthothiaoxa- or benzimidazocarbocyanines, provided that the dyes have at least one sulphoalkyl group on the heterocyclic nitrogen.

2. as green-sensitizers: 9-ethylcarbocyanines having benzoxazole, napththoxazole or one benzoxazole and one naphthoxazole as basic terminal groups, and benzimidazocarbocyanines, which may likewise be further substituted and must likewise contain at least one sulphoalkyl group on the heterocyclic nitrogen.

3. as blue-sensitizers: symmetrical or unsymmetrical benzimidazo-, oxa-, thia- or selenacyanines having at least one sulphoalkyl group on the heterocyclic nitrogen and optionally further substituents on the aromatic nucleus, and also apomerocyanines with a rhodanine group.

Sensitizers can be omitted if the intrinsic sensitivity of the silver halide is sufficient for a defined spectral region, for example the blue sensitivity of silver bromides.

Suitable compounds of formula I comprise:

I-1

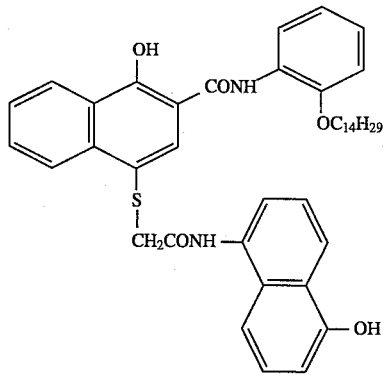

I-2

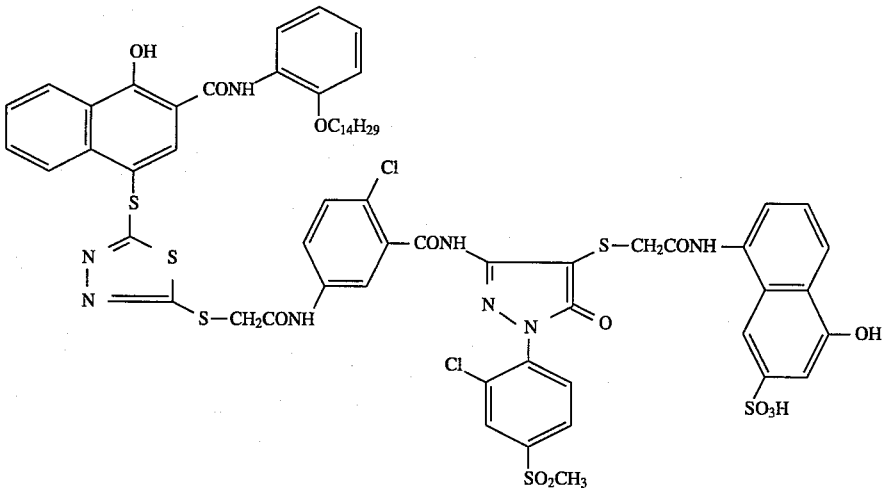

-continued
I-3
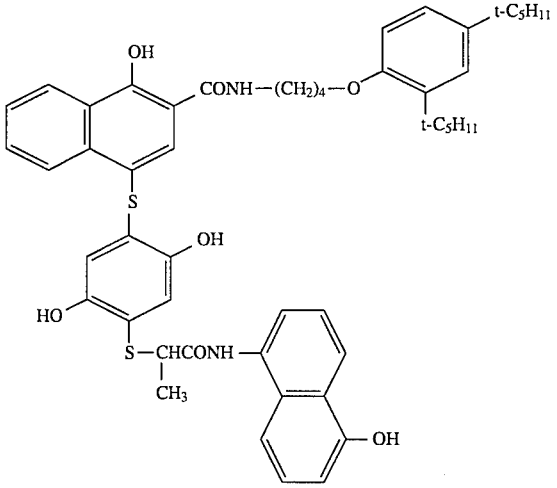
I-4
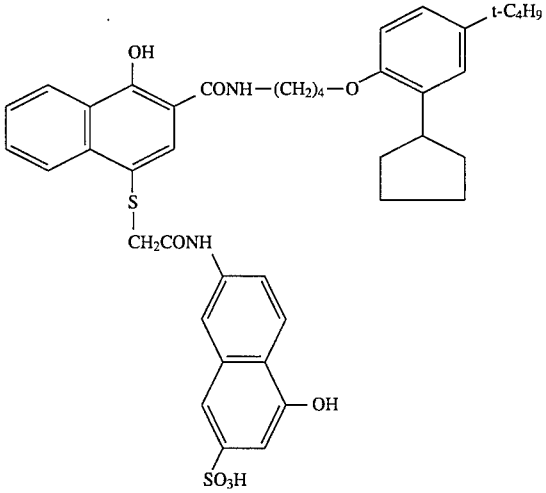
I-5
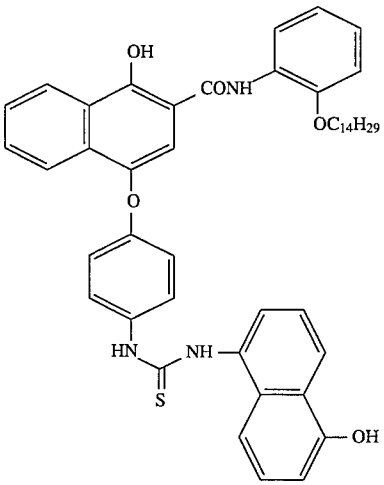
I-6
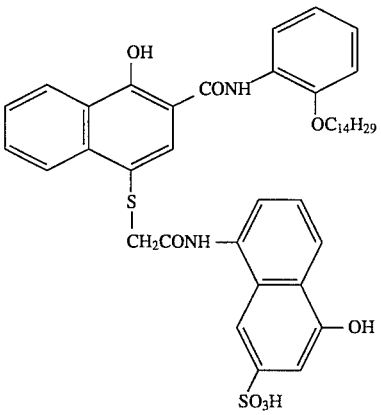
I-7
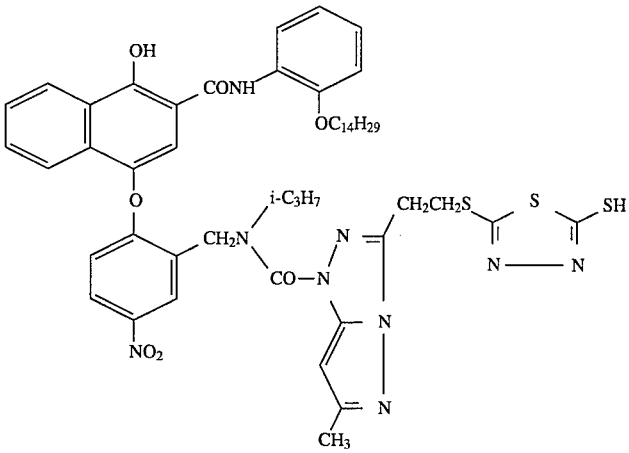

-continued
I-8
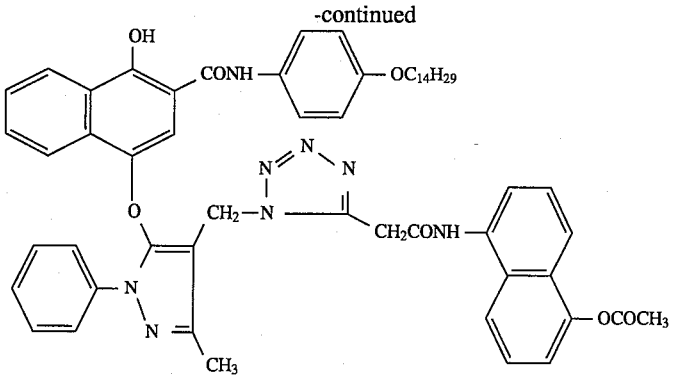
I-9
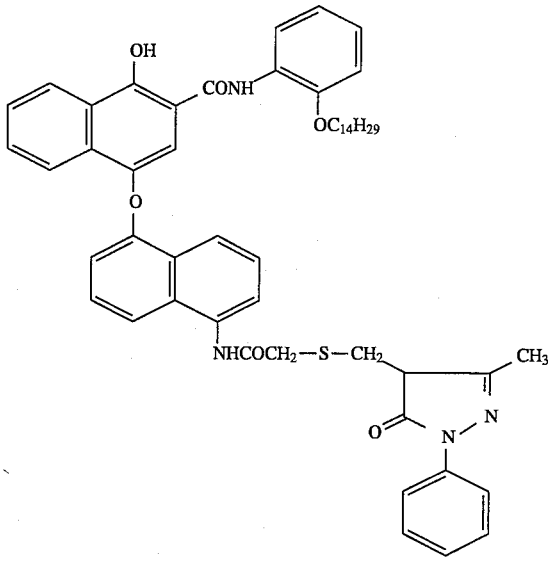
I-10
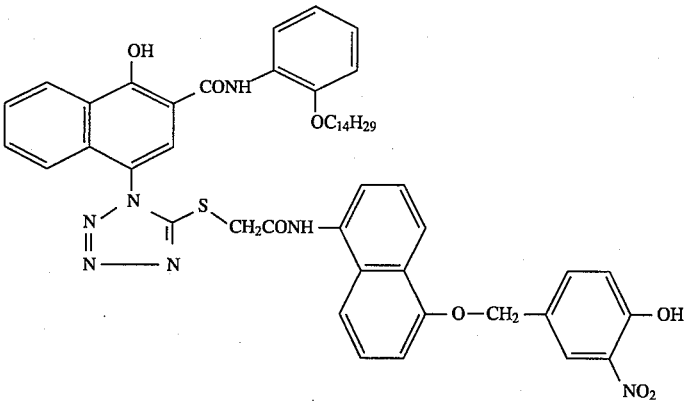

-continued
I-11
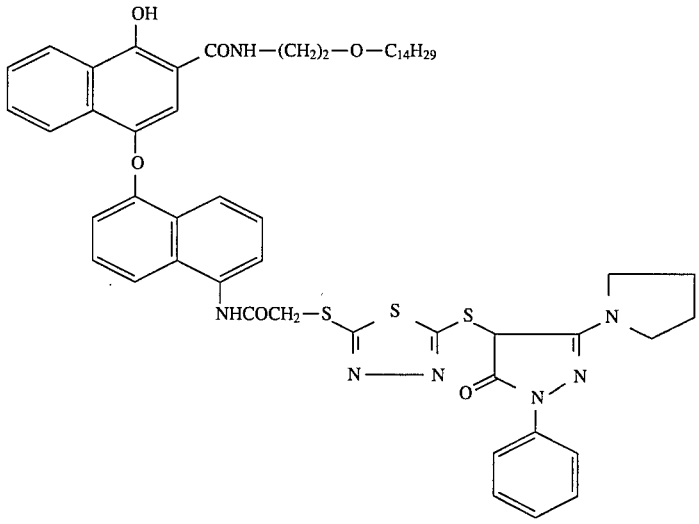
I-12
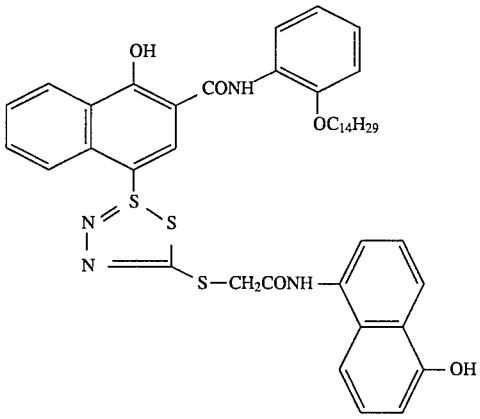
I-13
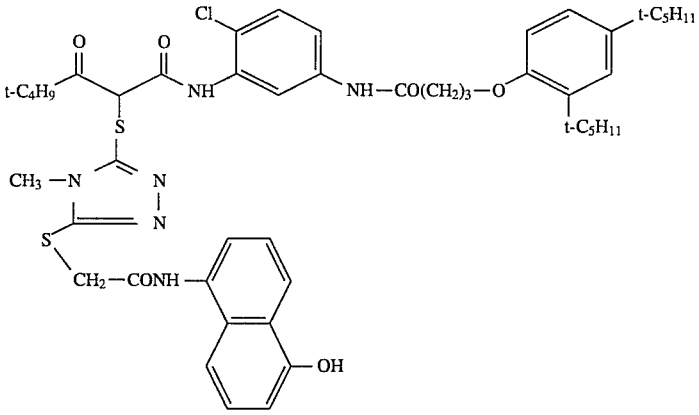

-continued
I-14
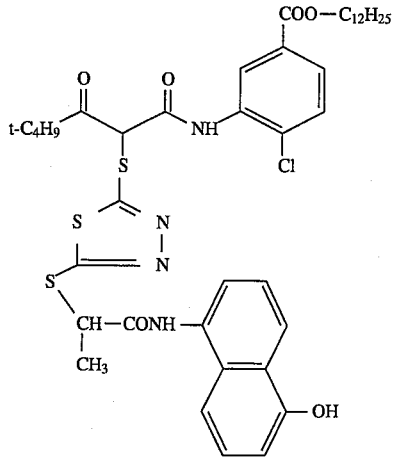
I-15
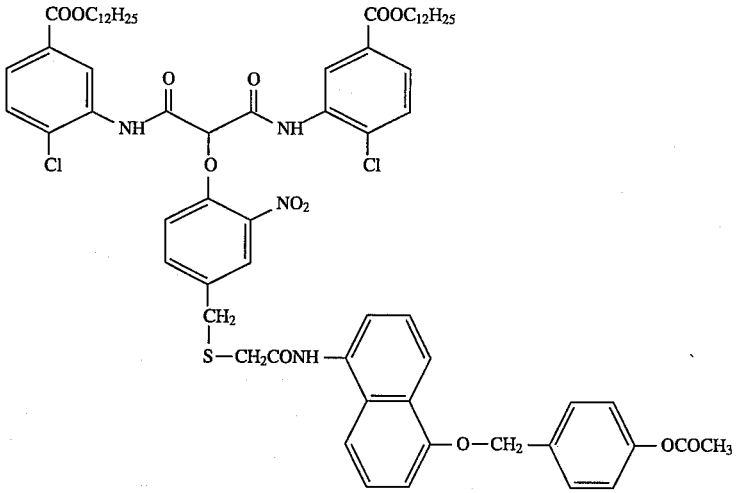
I-16
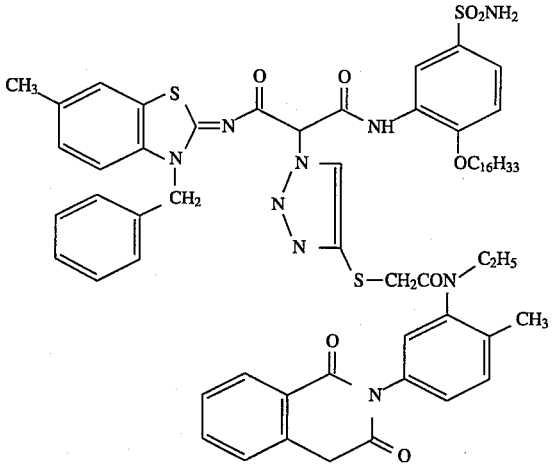

-continued
I-17
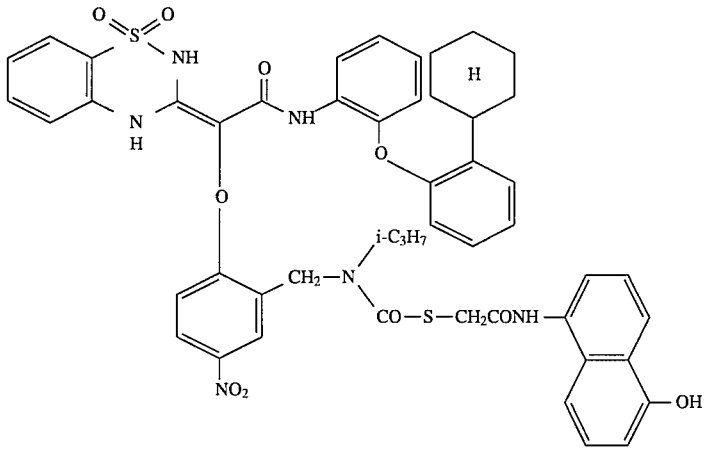
I-18
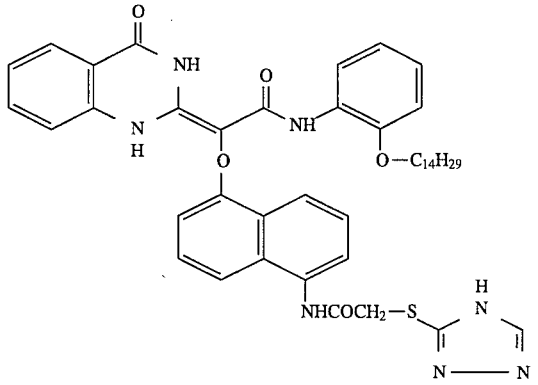
I-19
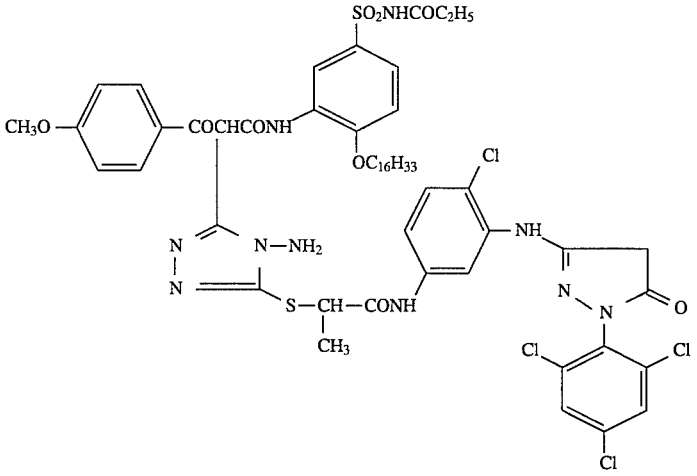
I-20
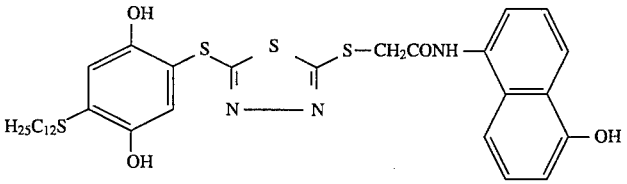
I-21
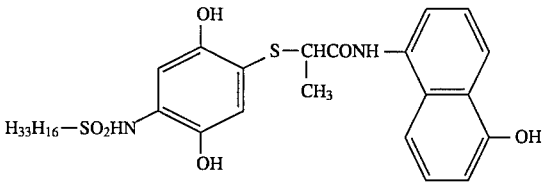

-continued
I-22
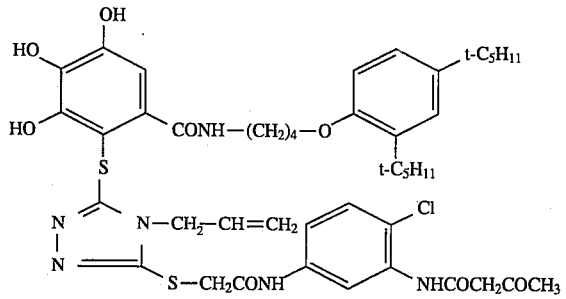
I-23
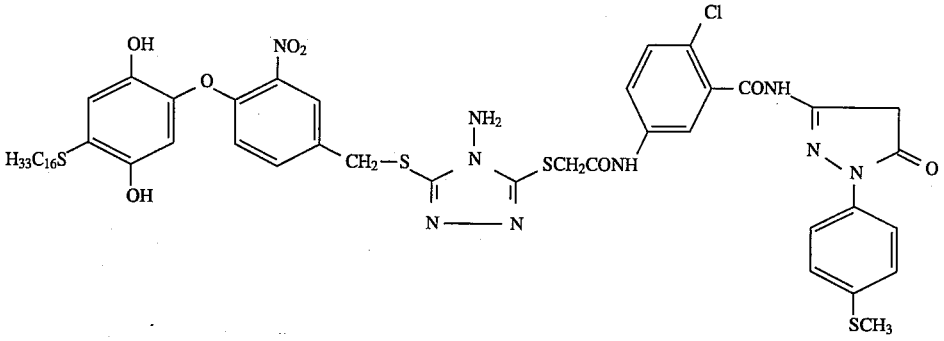
I-24
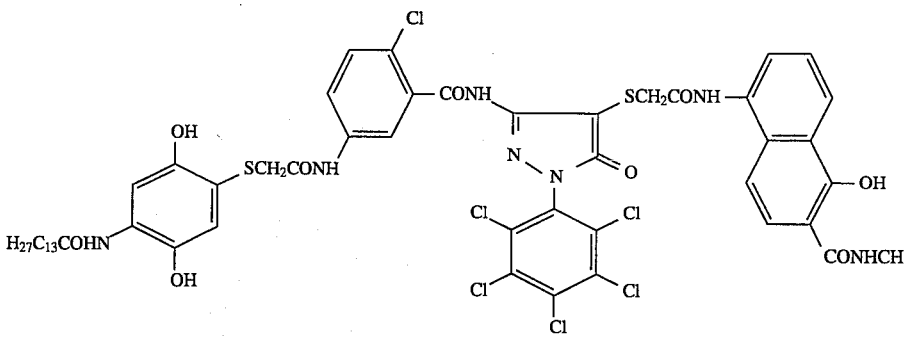
I-25
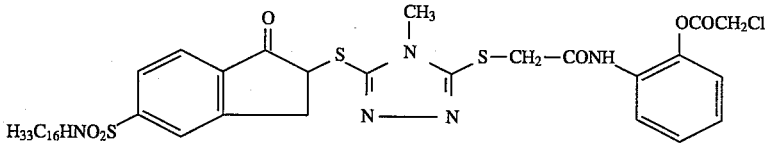
I-26
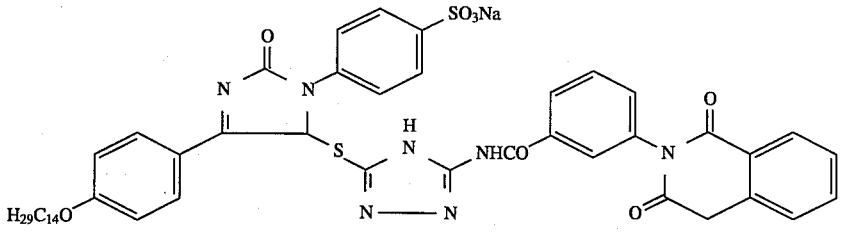

-continued
I-27
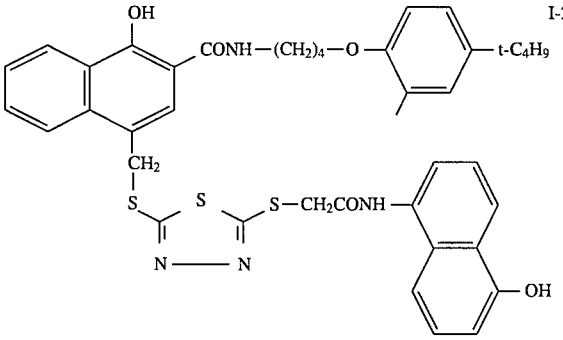
I-28
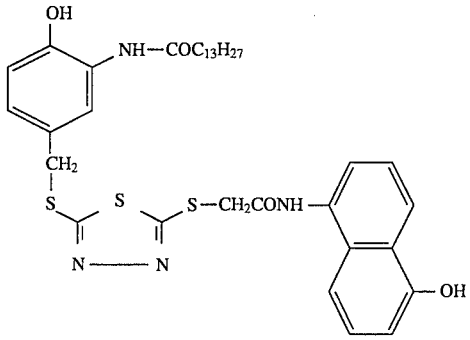
I-29
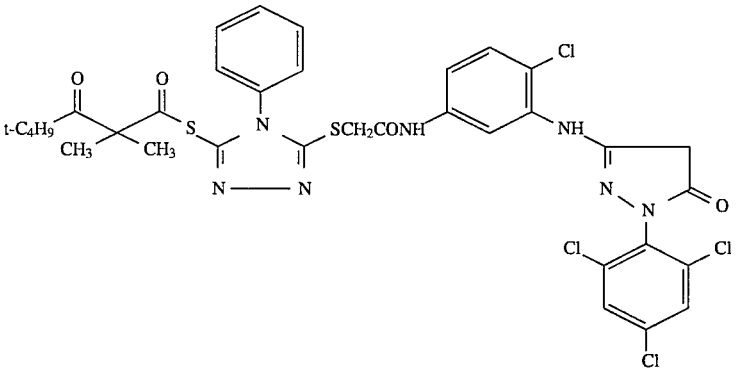
I-30
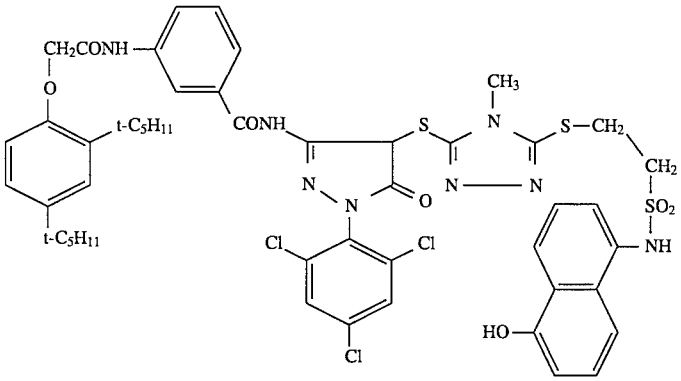
I-31
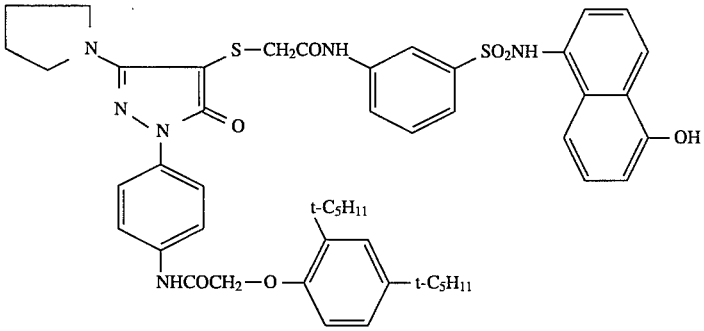

-continued

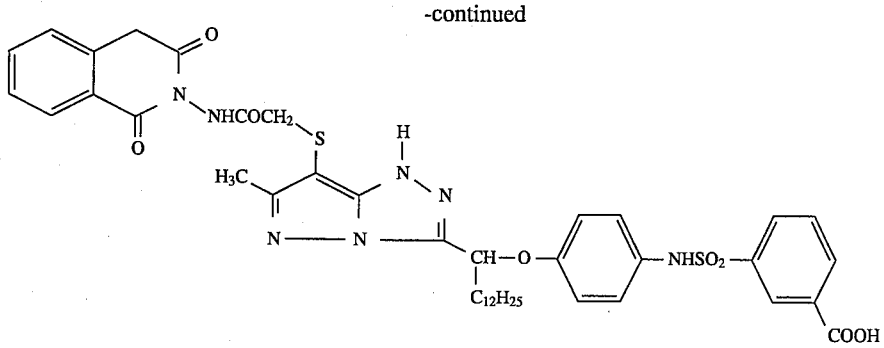

I-32

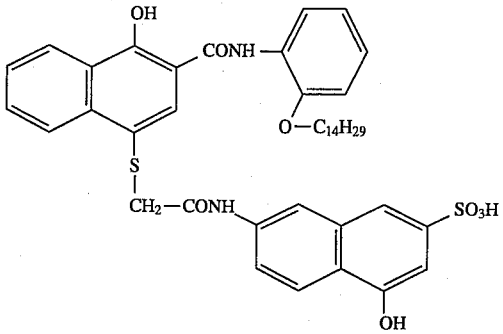

I-33

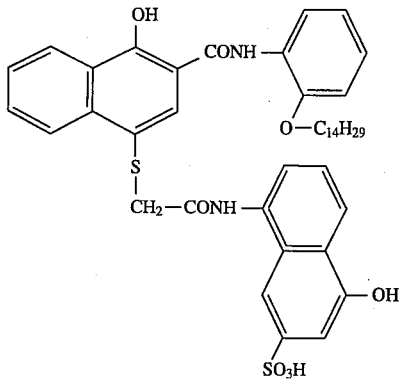

I-34

Preparation of compound I-1

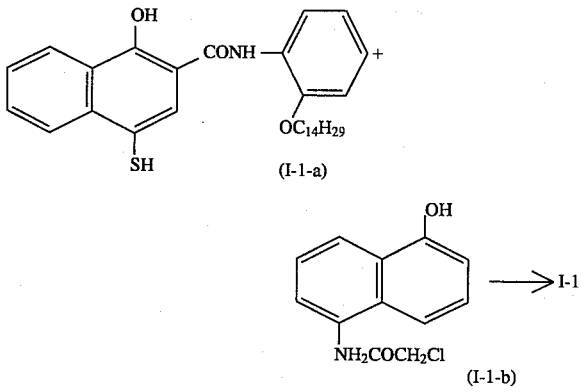

30.6 g of compound I-1-a and 14.1 g of compound I1-b were mixed by stirring them in 200 ml of dimethylacetamide; 7.8 ml of tetramethylguanidine were then added and the mixture was stirred for 1.5 hours at room temperature. The reaction mixture was added to a mixture of iced water and aqueous HCl and the precipitate was filtered off by suction, washed with water and methanol and dried. The residue was stirred hot with 200 ml of 1-chlorobutane, filtered off after cooling to room temperature, and washed with 1-chlorobutene. It was then stirred with a 4:1 methanol/ethyl acetate mixture, filtered and washed.

25.4 g of compound I-1 were obtained, which melted at 158° to 161° C.

Suitable compounds of formula II comprise

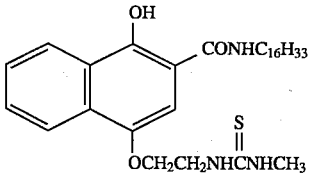

II-1

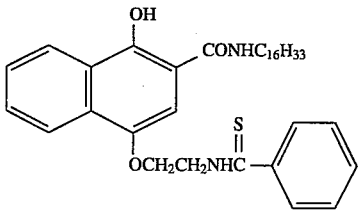

II-2

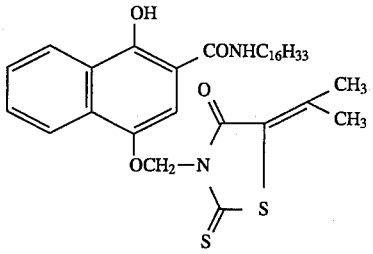

II-3

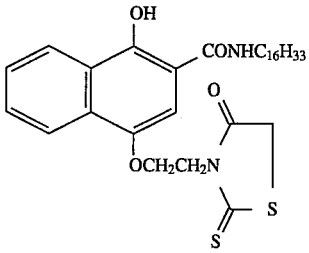

II-4

-continued
II-5
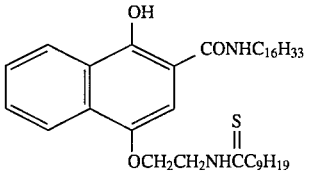
II-6
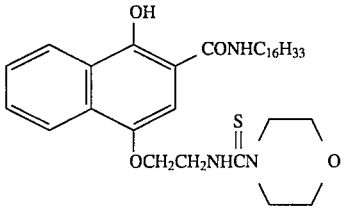
II-7
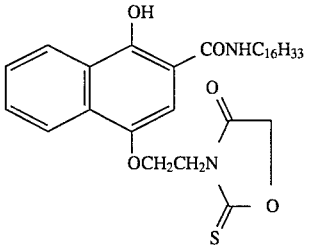
II-8
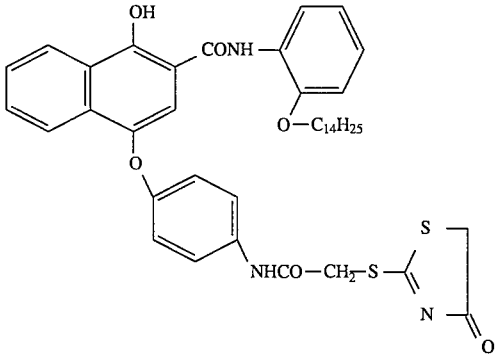
II-9
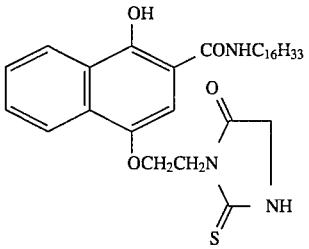
II-10
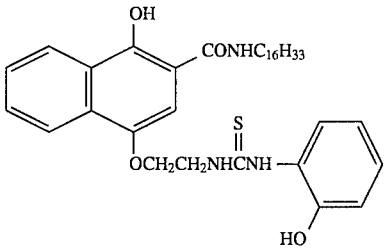
II-11
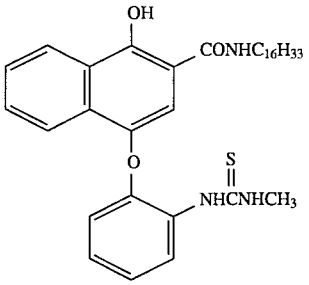
II-12
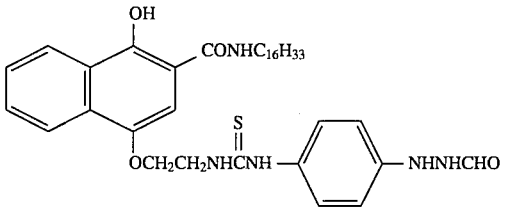
II-13
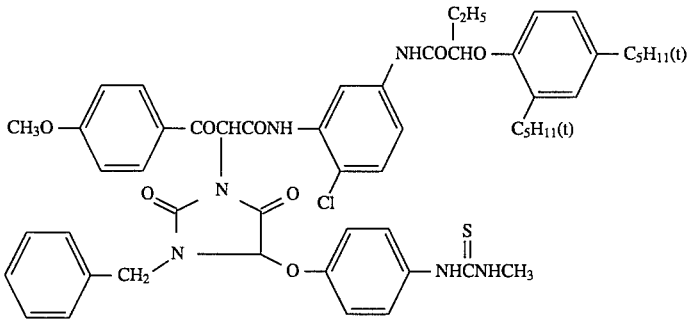

-continued

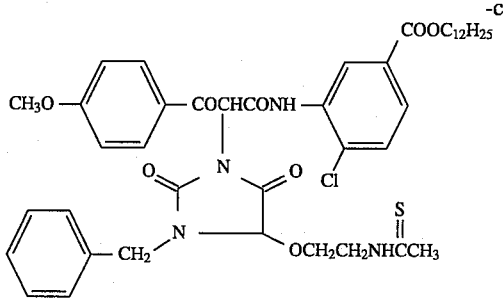

II-14

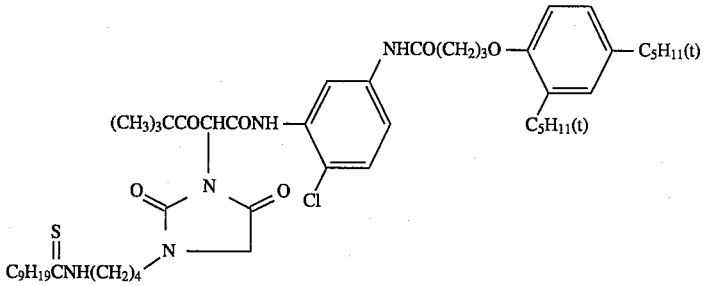

II-15

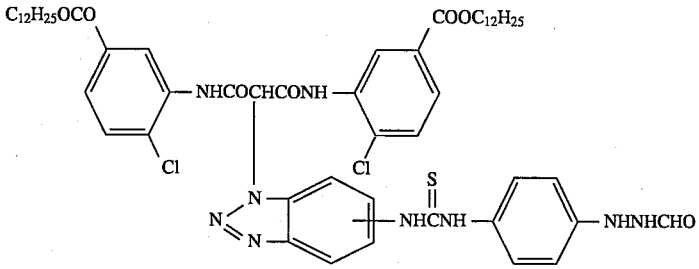

II-16

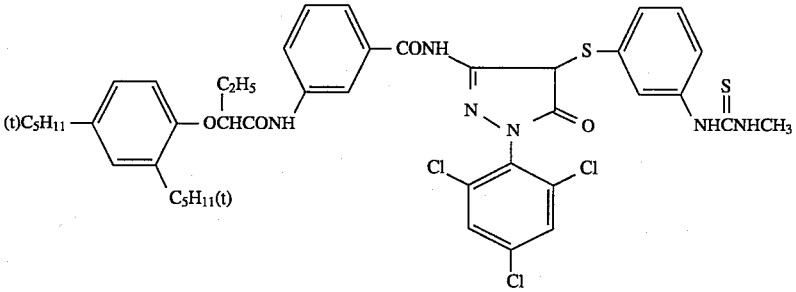

II-17

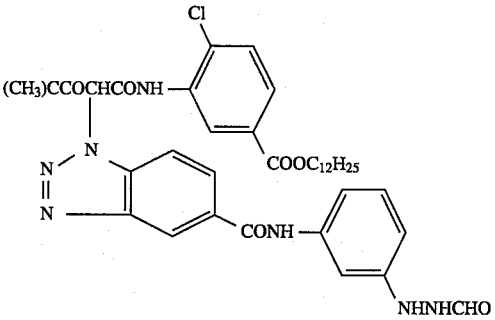

II-18

Non-diffusing, monomeric or polymeric colour couplers, which may be situated in the same layer or in a layer adjacent thereto, are associated with the differently sensitized emulsion layers. In general, cyan couplers are associated with the red-sensitive layers, magenta couplers with the green-sensitive layers, and yellow couplers with the blue-sensitive layers.

Colour couplers for producing the cyan partial colour image are generally couplers of the phenol or α-naphthol type.

Colour couplers for producing the magenta partial colour image are generally couplers of the 5-pyrazolone, indazolone or pyrazoloazole type.

Colour couplers for producing the yellow partial colour image are generally couplers containing an open-chain ketomethylene grouping, particularly couplers of the α-acylacetamide type; suitable examples of these include α-benzoylacetanilide couplers and α-pivaloylacetanilide couplers.

The colour couplers may be 4-equivalent couplers, but may also be 2-equivalent couplers. The latter are derived from 4-equivalent couplers in that they contain a substituent at the coupling site which is split off on coupling. Suitable 2-equivalent couplers comprise those which are colourless and also those which possess an intensive intrinsic colour which disappears or which is replaced by the colour of the image dye produced when colour coupling takes place (masking couplers), and white couplers which produce substantially colourless products on reaction with colour developer oxidation products. Suitable 2-equivalent couplers also include those couplers which contain a cleavable radical at the coupling site which is released on reaction with colour developer oxidation products, wherein a certain desirable photographic activity is thereby developed, e.g. as a development inhibitor (DIR coupler), either directly or after one or more other groups have been split off from the radical which is the primary radical split off (e.g. DE-A-27 03-145, DE-A-28 55 697, DE-A-31 05 026, DE-A-33 19 428).

DIR couplers which release development inhibitors of the azole type, e.g. triazoles and benzotriazoles, are described in DE-A-2 414 006, 2 610 546, 2 659 417, 2 754 281, 2 726 180, 3 626 219, 3 630 564, 3 636 824, 3 644 416 and 2 842 063. Other advantages for colour reproduction, e.g. colour separation and colour purity, and for the reproduction of detail, i.e. sharpness and brain, can be obtained using DIR couplers such as these, which for example do not split off the development inhibitor directly as a result of the coupling with an oxidized colour developer, but instead do not effect this until another secondary reaction has occurred, which is achieved with a time control group. for example. Examples of these are described in DE-A-28 55 697, 32 99 671, 38 18 231, 35 18 797, in EP-A-157 146 and 204 175, in U.S. Pat. Nos. 4,146,396 and 4,438,393 and in GB-A-2 072 363.

DIR couplers which release a development inhibitor which is decomposed in the developer bath to form products which are substantially photographically inactive, are described in DE-A-32 09 486 and in EP-A-167 168 and 219 713. Interference-free development and constancy of processing is achieved by means of this measure.

When DIR couplers are used, particularly those which split off a development inhibitor which can diffuse easily, improvements in colour reproduction, e.g. differentiated colour reproduction, can be obtained by means of suitable measures on optical sensitization. This is described, for example, in EP-A-115 304, 167 173, GB-A-2 165 058, DE-A-3 700 419 and U.S. Pat. No. 4,707,436.

In a multi-layer photographic material, the DIR couplers may be added to very different layers, e.g. they may also be added to light-insensitive or intermediate layers. However, they are preferably added to the light-sensitive silver halide emulsion layers, wherein the characteristic properties of the silver halide emulsion, e.g. its iodide content and the structure of the silver halide grains or their grain size distribution have an effect on the photographic properties obtained. The effect of the inhibitors released can be limited by the incorporation of an inhibitor scavenger layer according to DE-A-24 31 223, for example. For reasons of reactivity or stability it may be advantageous to employ a DIR coupler which on coupling forms a colour in the respective layer in which it is incorporated which differs from the colour to be produced in this layer.

It may be advantageous to modify the effect of a photographically active group which is split off from a coupler by causing an intermolecular reaction to take place between this group, after its release, and another group, according to DE-A-3 506 805.

Since for compounds of formula I and DIR couplers the effectiveness of the radical released on coupling is what is mainly desired, and the colour-forming properties of these couplers are of less importance, substances are also suitable which produce substantially colourless products on coupling (DE-A-1 547 640).

In addition, the material may contain compounds other than couplers, which for example can release a development inhibitor, a development accelerator, a bleach accelerator, a developer, a solvent for silver halide, a fogging agent or an anti-fogging agent, for example the so-called DIR hydroquinone and other compounds such as those described in U.S. Pat. Nos. 4,636,546, 4,345,024, 4,684,604 and in DE-A-3 145 640, 2 515 213, 2 447 079 and in EP-A-198 438. These compounds perform the same function as the DIR, DAR or FAR couplers, except that they form no coupling products.

Examples of high molecular weight colour couplers are described in DE-C-1 297 417, DE-A-24 07 569, DE-A-31 48 125, DE-A-32 17 200, DE-A-33 20 079, DE-A-33 24 932, DE-A-33 31 743, DE-A-33 40 376, EP-A-27 284, and U.S. Pat. No. 4,080,211. High molecular weight colour couplers are generally produced by the polymerization of ethylenically unsaturated monomeric colour couplers. They may also be obtained by addition polymerization or condensation polymerization, however.

The incorporation of couplers or other compounds may be effected by first preparing a solution, a dispersion or an emulsion of the compound concerned and then adding this to the casting solution for the layer concerned. The selection of a suitable solvent or dispersion medium depends on the respective solubility of the compound.

Methods of incorporating compounds which are substantially insoluble in water, by milling procedures, are described in DE-A-2 609 74 1 and DE-A-2 609 742, for example.

Hydrophobic compounds may also be introduced into the casting solutions using high-oiling solvents, known as oil-formers. Appropriate methods are, for example, described in U.S. Pat. Nos. 2,322,027, 2,801,170, 2,801,171 and EP-A-0043037.

Instead of high-boiling solvents, oligomers or polymers—termed polymeric oil-formers may also be used.

The compounds may also be incorporated in the casting solution in the form of loaded latexes. Reference is made in this respect to DE-A-2 541 230, DE-A-2 541 274, DE-A2 835 856, EP-A-O 014 921, EP-A-O 069 671, EP-A-O 130 115 and U.S. Pat. No. 4,291,113, for example.

The diffusion-resistant intercalation of water-soluble anionic compounds (e.g. of dyes) may also be effected with the aid of cationic polymers termed mordant polymers.

Examples of suitable oil-formers include phthalic acid alkyl esters, phosphonic acid esters, phosphoric acid esters, citric acid esters, benzoic acid esters, amides, fatty acid esters, trimesic acid esters, alcohols, phenols, aniline derivatives and hydrocarbons.

Examples of suitable oil-formers include dibutyl phthalate, dicyclohexyl phthalate, di-2-ethylhexyl phthalate, decyl phthaiate, triphenyl phosphate, tricresyl phosphate, 2-ethylhexyldiphenyl phosphate, tricyclohexyl phosphate, tri-2-ethylhexyl phosphate, tridecyl phosphate, tributoxyethyl phosphate, trichloropropyl phosphate, di-2-ethylhexyl phenyl phosphate, 2-ethylhexyl benzoate, dodecyl benzoate, 2-ethylhexyl-p-hydroxybenzoate, diethyl dodecanamide, N-tetradecyl pyrrolidone, isostearyl alcohol, 2,4-di-tert.amyl phenol, dioctyl acetate, glycerine tributyrate, isostearyl lactate, trioctyl citrate, N,N-dibutyl-2-butoxy-5-tert.-actylaniline, paraffin, dodecylbenzene and diisopropylnaphthalene.

Each of the differently sensitized light-sensitive layers may consist of a single layer or may also comprise two or more partial layers of silver halide emulsion (DE-C-1 121 470). In this respect, red-sensitive silver halide emulsion layers are frequently disposed nearer to the layer support than are green-sensitive silver halide emulsion layers, and the latter in turn are nearer than blue-sensitive layers, a light-insensitive yellow filter layer generally being situated between green-sensitive layers and blue-sensitive layers.

If the intrinsic sensitivity of the green- or red-sensitive layers is suitably low, other layer arrangements in which the yellow filter layer is omitted may be selected, in which the blue-sensitive, then the red-sensitive and finally the green-sensitive layers are situated in this order on the support, for example.

The light-insensitive intermediate layers which are generally disposed between layers of different spectral sensitivities may contain media which prevent the unwanted diffusion of developer oxidation products from one light-sensitive layer into another light-sensitive layer with a different spectral sensitization.

Suitable media, which are also termed scavengers or EOP scavengers, are described in Research Disclosure 17,463/1978, Section VII, 17,842/1979, pages 94–97 and 18,716/1979, page 650, in EP-A-69 070, 98 072, 124 877, 125 522 and in U.S. Pat. No. 463,226.

If a plurality of partial layers of the same spectral sensitization is present, these may differ as regards their composition, particularly as regards the type and amount of silver halide grains. In general, the partial layer of higher sensitivity will be disposed further from the support than will the partial layer of lower sensitivity. Partial layers with the same spectral sensitization may be adjacent to each other or may be separated by other layers, e.g. by layers with another spectral sensitization. For example, all the high-sensitivity layers and all the low-sensitivity layers may be combined to form a stack of layers (DE-A-19 58 709, DE-A-25 30 645, DE-A-26 22 922).

The photographic material may also contain compounds which absorb UV light, optical brighteners, spacers, filter dyes, formalin scavengers, light stabilizers, antioxidants, $D_{Min}$ dyes, additives for enhancing the stability of the dyes, couplers and brighteners and to reduce colour fogging, and others.

The layers of photographic material may be hardened with the usual hardeners. Examples of suitable hardeners include formaldehyde, glutaraldehyde and similar aldehyde compounds, diacetyl, cyclopentadione and similar ketone compounds, bis-(2-chloroethylurea), 2-hydroxy-4,6-dichloro-1,3,5-triazine and other compounds which contain reactive a halogen (U.S. Pat. Nos. 3,288,775, 2,732,303, GB-A-974 723 and GB-A 1167 207), divinyl sulphone compounds, 5-acetyl- 1,3-diacryloylhexahydio-1,3,5-triazine and other compounds which contain a reactive olefine bond (U.S. Pat. Nos. 3,635,718, 3,232,763 and GB-A 994 869); N-hydroxymethylphthalimide and other N-methylol compounds (U.S. Pat. Nos. 2,732,316 and 2,586,168); isocyanates (U.S. Pat. No. 3,103,437); aziridine compounds (U.S. Pat. Nos. 3,017,280 and 2,983,611); acid derivatives (U.S. Pat. Nos. 2,725,294 and 2,725,295); compounds of the carbodiimide type (U.S. Pat. No. 3,100,704); carbamoylpyridinium salts (DE-A 2 225 230 and DE-A 2 439 551 ); carbamoyloxypyridinium compounds (DE-A-2 408 814); compounds with a phosphorushalogen bond (JP-A- 113 929/83); N-carbonyloximide compounds (JP-A- 43353/81); N-sulphonyloximido compounds (U.S. Pat. No. 4,111,926), dihydroquinoline compounds (U.S. Pat. No. 4,013,468), 2-sulphonyloxypyridinium salts (JP-A- 110 762/81), formamidinium salts (EP-A 0 162 308), compounds containing two or more N-acyloximino groups (U.S. Pat. No. 4,052,373), epoxy compounds (U.S. Pat. No. 3,091,537), compounds of the isoxazole type (U.S. Pat. Nos. 3,321,313 and 3,543,292); halogenocarboxyaldehydes such as mucochloric acid; dioxane derivatives such as dihydroxydioxane and di-chlorodioxane; and inorganic hardeners such as chrome alum and zirconium sulphate.

Hardening may be effected in the known manner by adding the hardener to the casting solution for the layer to be hardened, or by overcoating the layer to be hardened with a layer which contains a hardener which is capable of diffusing.

Suitable classes of hardeners comprise slow-acting and rapid-acting hardeners and the so-called instantaneous hardeners, which are particularly advantageous. The term "instantaneous hardeners" is to be understood as meaning compounds which crosslink suitable binders so that hardening is complete directly after casting, at the latest after 24 hours, and preferably after 8 hours, to an extent such that no further changes in sensitometry and swelling of the composite layer occur due to the crosslinking reaction. Swelling is understood to be the difference between the wet layer thickness and the dry layer thickness during the aqueous processing of the film (Photogr. Sci. Eng. 8 (1964), 275; Photogr. Sci. Eng. (1972), 449).

These hardeners which react very rapidly with gelatine comprise carbamoyl pyridinium salts, for example, which are capable of reacting with free carboxyl groups of the gelatine, so that the latter react with free amino groups of the gelatine with the formation of peptide bonds and with crosslinking of the gelatine.

Colour photographic negative materials are usually processed by developing, bleaching, fixing and washing, or by developing, bleaching, fixing and stabilizing without subsequent washing, wherein bleaching and fixing may be combined to form one processing step. All developer compounds which are capable of reacting, in the form of their oxidation product, with colour couplers to form azomethine or indophenol dyes can be used as colour developer compounds. Suitable colour developer compounds comprise aromatic compounds of the p-phenylene diamine type which contain at least one primary amino group, for example N,N-dialkyl-p-phenylenediamines such as N,N-diethyl-p-phenylenediamine, 1-(N-ethyl-N-methanesulphonamidoethyl)-3-methyl-p-phenylenediamine, 1-(N-ethyl-N-hydroxyethyl)-3-methyl-p-phenylenediamine and 1-(N-ethyl-N-methoxyethyl)-3-methyl-p-phenylenediamine. Examples of other colour developers which can be used are described in J. Amer. Chem. Soc. 73, 3106 (1951), and by G. Haist in Modern Photographic Processing, 1979, John Wiley and Sons, New York, page 545 et seq.

An acid stop bath or a washing stage may follow the colour development stage.

The material is usually bleached and fixed immediately after colour development. Fe(III) salts and Fe(III) complex salts such as ferricyanides, and dichromates and water-soluble cobalt salts can be used as bleaching agents, for example. Iron (III) complexes of aminopolycarboxylic acids are particularly preferred, particularly those of ethylenediamine tetraacetic acid, propylenediamine tetraacetic acid, diethylenetriamine pentaacetic acid, nitrilotriacetic acid, iminodiacetic acid, N-hydroxyethyl-ethylenediamine triacetic acid, alkyliminodicarboxylic acids, and those of corresponding phosphonic acids. Persulphates are also suitable as bleaching agents.

The bleach fixing bath or fixing bath is mostly followed by a washing stage, which is conducted as a counter-current washing operation or which consists of a plurality of tanks with their own water supply.

Favourable results can be obtained when subsequently employing a final bath which contains no formaldehyde or only a little formaldehyde.

The washing stage may be completely replaced by a stabilizing bath, however, which is usually operated with counter-current flow. When formaldehyde is added this stabilizing bath also takes over the function of the final bath.

EXAMPLE 1

A colour photographic recording material for colour negative colour development was produced (layer structure 1A) by applying the following layers in the order cited to a transparent layer support made of cellulose triacetate. The amounts quoted each relate to 1 $m^2$. For the application of silver halide the corresponding amounts of $AgNO_3$ were stabilized with 0.5 g of 4-hydroxy-6-methyl-1,3,3a,7-tetraazaindene.

1st Layer (anti-halo layer)

| | | |
|---|---|---|
| 0.3 | g | black colloidal silver |
| 1.2 | g | gelatine |
| 0.4 | g | UV absorber UV-1 |
| 0.02 | g | tricresyl phosphate (TCP) |

2nd layer (micrate intermediate layer)

| | | |
|---|---|---|
| 0.25 | g | $AgNO_3$ of a micrate-Ag(BrI) emulsion, average grain diameter 0.07 μm, 0.5 mole % iodide |
| 1.0 | g | gelatine |

3rd layer (low red-sensitivity layer)

| | | |
|---|---|---|
| 2.7 | g | $AgNO_3$ of a spectrally red-sensitized Ag(BrI) emulsion containing 4 mole % iodide, average grain diameter 0.5 μm |
| 2.0 | g | gelatine |
| 0.88 | g | colourless coupler C1 |
| 0.02 | g | DIR coupler D 1 |
| 0.05 | g | chromatic coupler RC-1 |
| 0.07 | g | chromatic coupler YC-1 |
| 0.75 | g | TCP |

4th layer (high red-sensitivity layer)

| | | |
|---|---|---|
| 2.2 | g | $AgNO_3$ of a spectrally red-sensitized Ag(BrI) emulsion, 12 mole % iodide, average grain diameter 1.0 μm |
| 1.8 | g | gelatine |
| 0.19 | g | colourless coupler C 2 |
| 0.17 | g | TCP |

5th layer (intermediate layer)

| | | |
|---|---|---|
| 0.4 | g | gelatine |
| 0.15 | g | white coupler W-1 |

UV-1

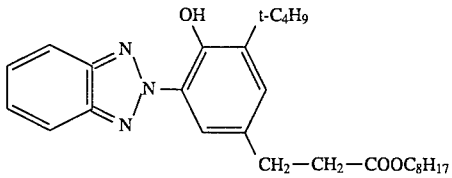

-continued

| | | |
|---|---|---|
| 0.06 | g | aluminium salt of aurintricarboxylic acid |

6th layer (low green-sensitivity layer)

| | | |
|---|---|---|
| 1.9 | g | $AgNO_3$ of a spectrally green-sensitized Ag(BrI) emulsion, 4 mole % iodide, average grain diameter 0.35 μm |
| 1.8 | g | gelatine |
| 0.54 | g | colourless coupler M-1 |
| 0.24 | g | DIR coupler D 1 |
| 0.065 | g | chromatic coupler YM-1 |
| 0.6 | g | TCP |

7th layer (high green-sensitivity layer)

| | | |
|---|---|---|
| 1.25 | g | $AgNO_3$ of a spectrally red-sensitized Ag(BrI) emulsion, 9 mole % iodide, average grain diameter 0.8 μm |
| 1.1 | g | gelatine |
| 0.195 | g | colourless coupler M-2 |
| 0.05 | g | chromatic coupler YM-2 |
| 0.245 | g | TCP |

8th layer (yellow filter layer)

| | | |
|---|---|---|
| 0.09 | g | yellow colloidal silver |
| 0.25 | g | gelatine |
| 0.08 | g | scavenger SC1 |
| 0.40 | g | formaldehyde scavenger FF-1 |
| 0.08 | g | TCP |

9th layer (low blue-sensitivity layer)

| | | |
|---|---|---|
| 0.9 | g | $AgNO_3$ of a spectrally blue-sensitized Ag(BrI) emulsion, 6 mole % iodide, average grain diameter 0.6 μm |
| 2.2 | g | gelatine |
| 1.1 | g | colourless coupler Y-1 |
| 0.037 | g | DIR coupler D-1 |
| 1.14 | g | TCP |

10th layer (high blue-sensitivity layer)

| | | |
|---|---|---|
| 0.6 | g | $AgNO_3$ of a spectrally blue-sensitized Ag(BrI) emulsion, 10 mole % iodide, average grain diameter 1.2 μm |
| 0.6 | g | gelatine |
| 0.2 | g | colourless coupler Y-1 |
| 0.003 | g | DIR coupler D-1 |
| 0.22 | g | TCP |

11th layer (micrate layer)

| | | |
|---|---|---|
| 0.06 | g | $AgNO_3$ of a micrate Ag(BrI) emulsion, average grain diameter 1.2 μm, 0.5 mole % iodide |
| 1 | g | gelatine |
| 0.3 | g | UV absorber UV-2 |
| 0.3 | g | TCP |

12th layer (protective and hardener layer)

| | | |
|---|---|---|
| 0.25 | g | gelatine |
| 0.75 | g | hardener of formula |

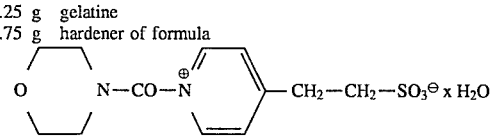

so that the overall layer structure after hardening had a swelling factor ≦3.5.

Substances used in Example 1:

-continued
UV-2
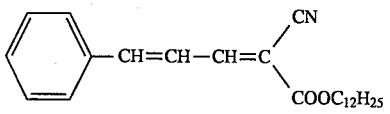
C 1
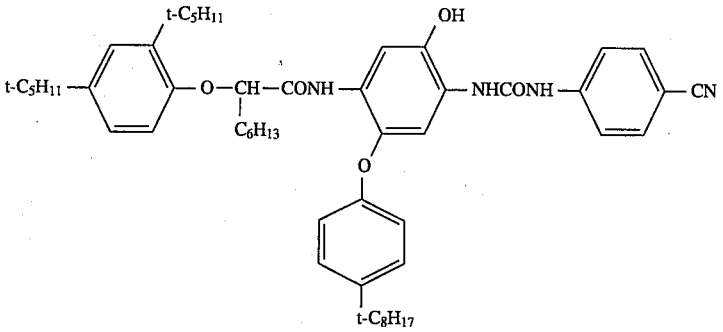
C 2
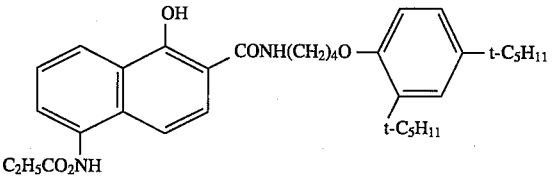
RC-1
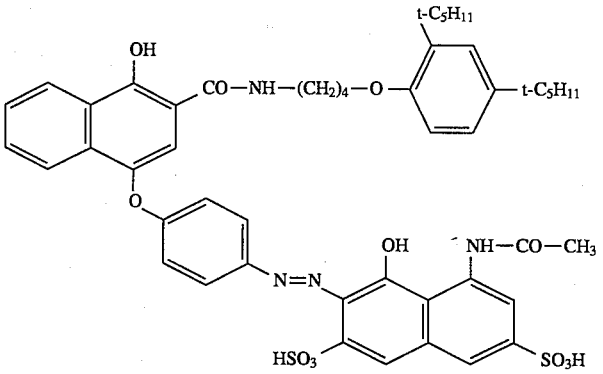
M-1
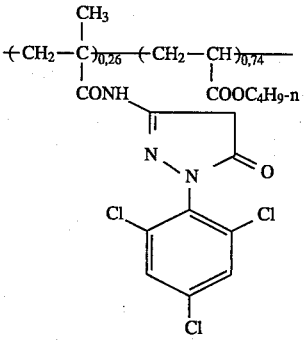

-continued
M2
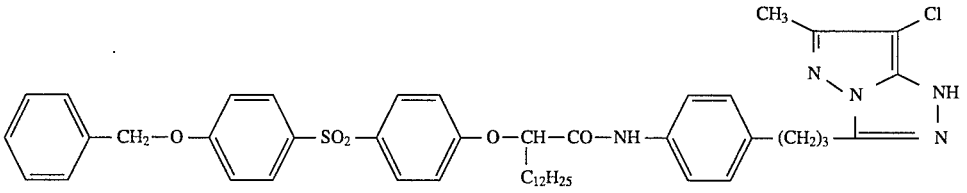
YM-1
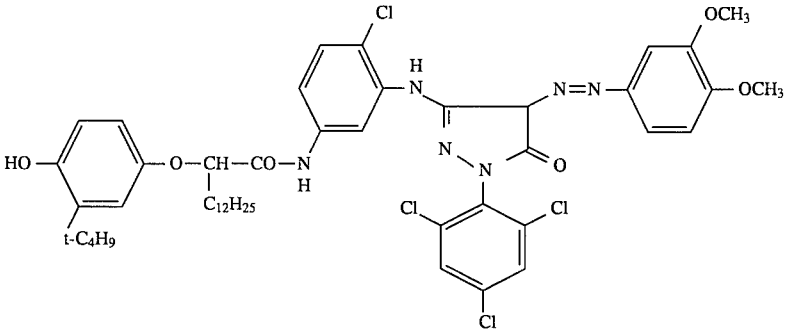
Y 1
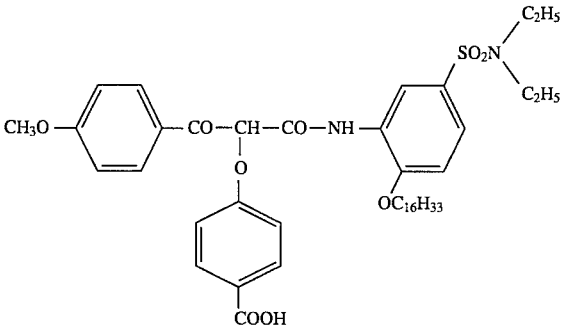
D-1
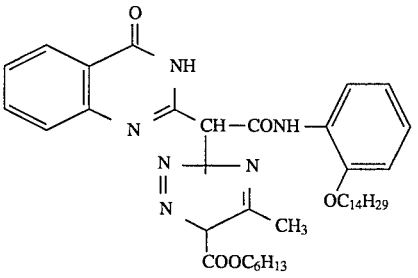

-continued
YC-1
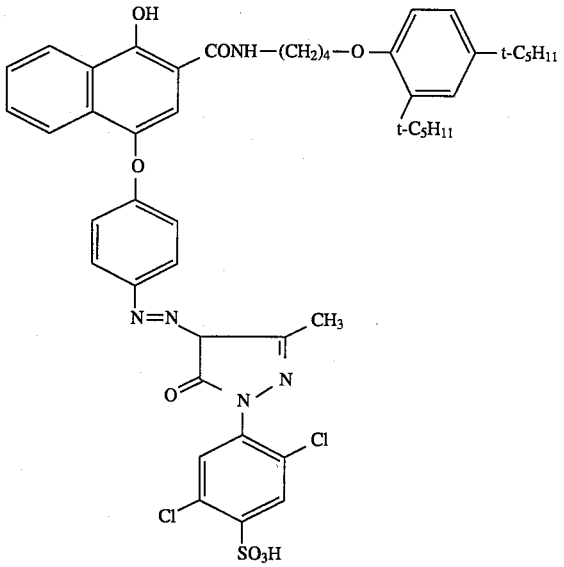
YM-2
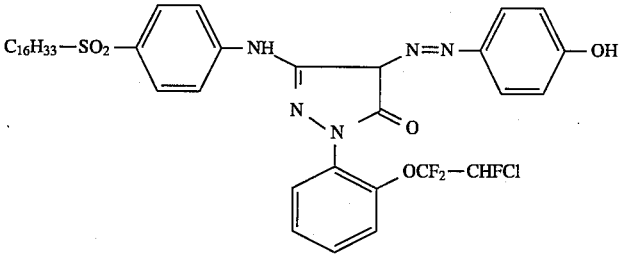
SC-1
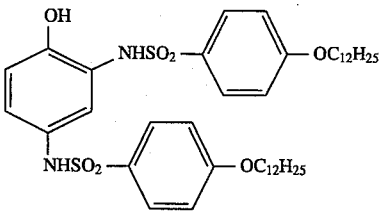
FF-1
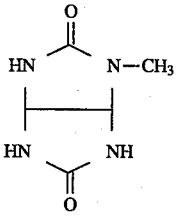

-continued

W-1

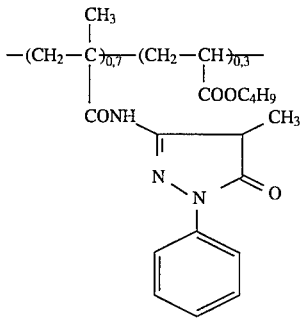

In layer structure 1B compound II-8 was also added to the 11th layer in an amount of 1 mg/m$^2$. The results are presented in Table 1.

In layer structure 1C compound I-1 was also added to the 8th layer in an amount of 1 mg/m$^2$. The results are presented in Table 2.

In layer structure 1D compound II-18 was also added to the 4th layer in an amount of 1.5 mg/m$^2$, and in layer structure 1E compound II-18 was also added to the 5th layer in an amount of 1.5 mg/m$^2$. The results are presented in Table 3.

After the exposure of a wedge filter, development was effected according to "The British Journal of Photography", 1974, pages 597 and 598.

TABLE 1

| Material | Compound | Relative sensitivity (yellow) | RMS granularity D = 0.5 | Remarks |
|---|---|---|---|---|
| 1A | — | 100 | 20.3 | Comparison |
| 1B | II-8 | 112 | 20.2 | Invention |

TABLE 2

| Material | Compound | Relative sensitivity (magenta) | RMS granularity D = 0.5 | Remarks |
|---|---|---|---|---|
| 1A | — | 100 | 15.3 | Comparison |
| 1C | II-1 | 108 | 15.4 | Invention |

TABLE 3

| Material | Compound | Relative sensitivity (yellow) | RMS granularity D = 0.5 | Remarks |
|---|---|---|---|---|
| 1A | — | 100 | 15.0 | Comparison |
| 1D | II-18 | 122 | 19.8 | Comparison |
| 1E | II-18 | 120 | 15.1 | Invention |

The results verify that when a compound according to the invention is added to a light-insensitive layer adjacent to a light-sensitive layer improvements in sensitivity are obtained without deterioration of granularity (materials 1B, 1C, 1E).

If such a compound is introduced into a light-sensitive layer, an improvement in sensitivity is also obtained, but a drastic deterioration of granularity occurs at the same time (material 1D).

We claim:

1. A color negative film comprising a support and at least one light-sensitive silver halide emulsion layer containing a color coupler and at least one light-insensitive layer adjacent to said light-sensitive layer, wherein the adjacent, light-insensitive layer contains a compound which reacts with a developer oxidation product during development with the splitting off of a radical which increases the sensitivity and which corresponds to formula I:

$$A\text{-}B\text{-}(T_1)_m\text{-}(COUP\text{-}D)\text{-}(T_2)_n \quad (I).$$

wherein

A represents a ballast radical,

B represents the radical of a compound which reacts during development with the splitting off of $(T_1)_m$-(COUP-D)-$(T_2)_n$, $T_1$ and $T_2$ are identical or different and are time control elements which can be split off during development, m and n are identical or different and represent 0 or 1, COUP represents the radical of a 4-equivalent coupler, and D represents a group with an affinity for silver halide and is selected from the group consisting of IIa, IIb, IIc, IId and IIe

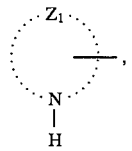

IIa

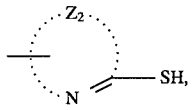

IIb

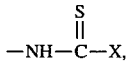

IIc

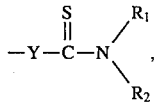

IId

IIe where $Z_1$ represents the remaining members for the completion of a 5- or 6-membered ring which contains at least one additional heteroatom, $Z_2$ represents the remaining members for the completion of a 5- or 6-membered ring, X represents —$NH_2$, —NHR,

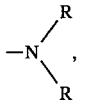

—SR or —OR,

Y represents —S—, —NR— or —O—,

R represents an aliphatic, aromatic or heterocyclic radical, and $R_1$ and $R_2$ independently of one another represent H, an aliphatic, aromatic or heterocyclic radical, or jointly represent the remaining members of a 5- or 6-membered ring.

2. The color negative film according to claim 1, wherein the compound which reacts with the developer oxidation product is used in an amount of from 0.0005 mmole to 0.05 mmole/$m^2$ of color negative film.

3. The color negative film according to claim 1, wherein D is bonded to the four equivalent coupler directly or via an intermediate member Z.

4. The color negative film according to claim 3, wherein $Z_1$ and $Z_2$ are identical and different and are selected from the group consisting of alkylene groups, arylene groups,

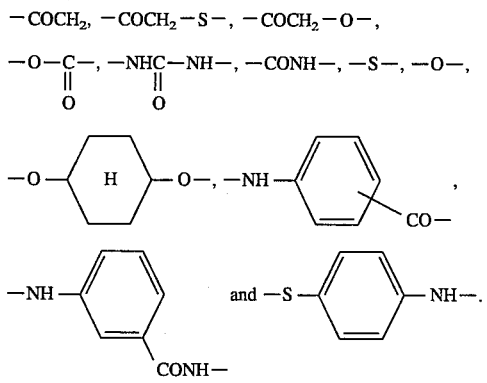

5. The color negative film according to claim 4, wherein (COUP-D) is bonded to $T_1$ via a bond to COUP or a bond to D and (COUP-D) is bonded to $T_2$ via a bond to COUP or a bond to D.

6. The color negative film according to claim 1, wherein the compound of formula I is used in one layer or is distributed over a plurality of layers.

* * * * *